US006499201B2

(12) United States Patent
Fildan et al.

(10) Patent No.: US 6,499,201 B2
(45) Date of Patent: Dec. 31, 2002

(54) GARMENT FASTENER ESPECIALLY FOR SWIMWEAR AND LINGERIE

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 22 days.

(21) Appl. No.: 09/770,004

(22) Filed: Jan. 25, 2001

(65) Prior Publication Data

US 2002/0095752 A1 Jul. 25, 2002

(51) Int. Cl.[7] ..... A41D 27/00; A41F 1/00; A44B 11/25

(52) U.S. Cl. ..... 24/586.11; 24/198; 24/200; 24/500; 24/318; 2/73

(58) Field of Search ..... 24/198, 200, 196, 24/197, 318, 500, 586.11; 2/73

(56) References Cited

U.S. PATENT DOCUMENTS

| | | | | | |
|---|---|---|---|---|---|
| 2,173,889 | A | * | 9/1939 | Troendly | 24/200 |
| 3,066,374 | A | * | 12/1962 | Garson | 24/198 |
| 4,161,806 | A | * | 7/1979 | Hennisse et al. | 24/201 |
| 4,520,533 | A | * | 6/1985 | Kasai | 24/198 |
| 4,677,711 | A | * | 7/1987 | Anscher | 24/200 |
| 4,713,865 | A | * | 12/1987 | Geldwerth | 24/616 |
| 5,715,580 | A | * | 2/1998 | Johnson, III | 24/200 |
| 5,899,791 | A | * | 5/1999 | Fildan | 24/200 |
| 6,009,604 | A | * | 1/2000 | Fildan | 24/662 |
| 6,056,626 | A | * | 5/2000 | Fildan | 24/198 |

FOREIGN PATENT DOCUMENTS

| | | | | |
|---|---|---|---|---|
| DE | 0460953 | * | 6/1928 | 24/198 |
| FR | 1087281 | * | 2/1955 | 24/200 |
| FR | 1105687 | * | 12/1955 | 24/586 |

* cited by examiner

*Primary Examiner*—Victor Sakran
(74) *Attorney, Agent, or Firm*—Herbert Dubno

(57) ABSTRACT

A garment fastener, especially for lingerie and swimsuits has elongated loops on each fastener half from the outer bar of which an attachment flange extends. The attachment flange is a sewing flange and/or welding flange and the fabric strip passing through the slot of the loop is stitched and/or welded to the attachment flange.

19 Claims, 6 Drawing Sheets

GARMENT FASTENER ESPECIALLY FOR SWIMWEAR AND LINGERIE

FIELD OF THE INVENTION

Our present invention relates to a garment fastener, especially for swim wear and lingerie, and which, in particular, can be fabricated from a polycarbonate synthetic resin or other transparent synthetic resin material.

BACKGROUND OF THE INVENTION

The provision of garment fasteners for securing two parts of a garment together in a releasable manner, e.g. a strap and a body of a garment or two strap segments of a garment has a number of important requirements especially when the garment is a swimsuit or an item of lingerie, such as a brassiere. Usually the garment fastener must be relatively small so as not to contribute an unaesthetic feature to the garment. Nevertheless it must be easily manipulated, of sufficient strength to withstand tensile stresses to which it may be subjected, and it must be securely held by the garment part to which it is affixed. While garment fasteners with loops through which straps or strap-like strips of the garment can be passed, have been provided in the past, a variety of problems are associated with them. Firstly, it cannot always be guaranteed that the strap or fabric strip passing through an elongated loop will remain distributed uniformly over the length of the slot. Furthermore, the attachment of the fastener part to the fabric is often unreliable. The problem is most pronounced where the fasteners must be openable and closeable and must be relatively small.

OBJECTS OF THE INVENTION

It is therefore the principal object of the present invention to provide a garment fastener for swimsuits, brassieres and lingerie whereby the drawbacks of the earlier systems are avoided.

Another object of this invention is to provide a garment fastener for the purposes described which affords a more reliable attachment of the fastener part to the garment part in a garment fastener of the type in which an elongated loop receives a strap or strip of the fastener.

SUMMARY OF THE INVENTION

These objects and others which will become more readily apparent hereinafter are attained, in accordance with the invention in a garment fastener of the type having an elongated loop defining a slot through which a strap or strip of the fabric is to be passed and in which the bar at the outside of that loop has formed unitarily therewith an attachment flange which is secured to the fabric by stitching and/or welding. This generally flat, thin attachment flange can be pierced through by the stitching needle by which the strap or fabric strap is secured and the stitching has the advantage that, if the stitching is removed, the strap or strip can be drawn through the slot to adjust the relative position of the fabric and the attachment flange and thereby allow restricting to expand the garment or allow it to be contracted.

Advantageously, that bar can have on its inner side, of convex formation, i.e. a curved bump, assisting in distributing the fabric in the slot uniformly.

The flange may be secured to the fabric also by welding or exclusively by welding as may be desired.

The garment fastener according to the invention can comprise:

a fastener body adapted to be affixed to first part of a garment;

a loop formed on the body and provided with an elongated slot through which a portion of a second part of the garment can be passed; and an attachment flange coplanar with the loop and of a thickness smaller than that of the body and the loop projecting from the loop away from the body and overlain by a portion of the second part of the garment adjacent the portion passed through the loop, the attachment flange being secured to the second part of the garment along the portion of the second part overlying the attachment flange.

According to a feature of the invention, the attachment flange can taper in thickness away from the loop or bar and can be provided on at least one side and preferably both sides with arrays of mutually orthogonal ribs or can be constituted by the mutually orthogonal ribs.

The two halves of the garment fastener, which can releasably interengage, can be identical to one another.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
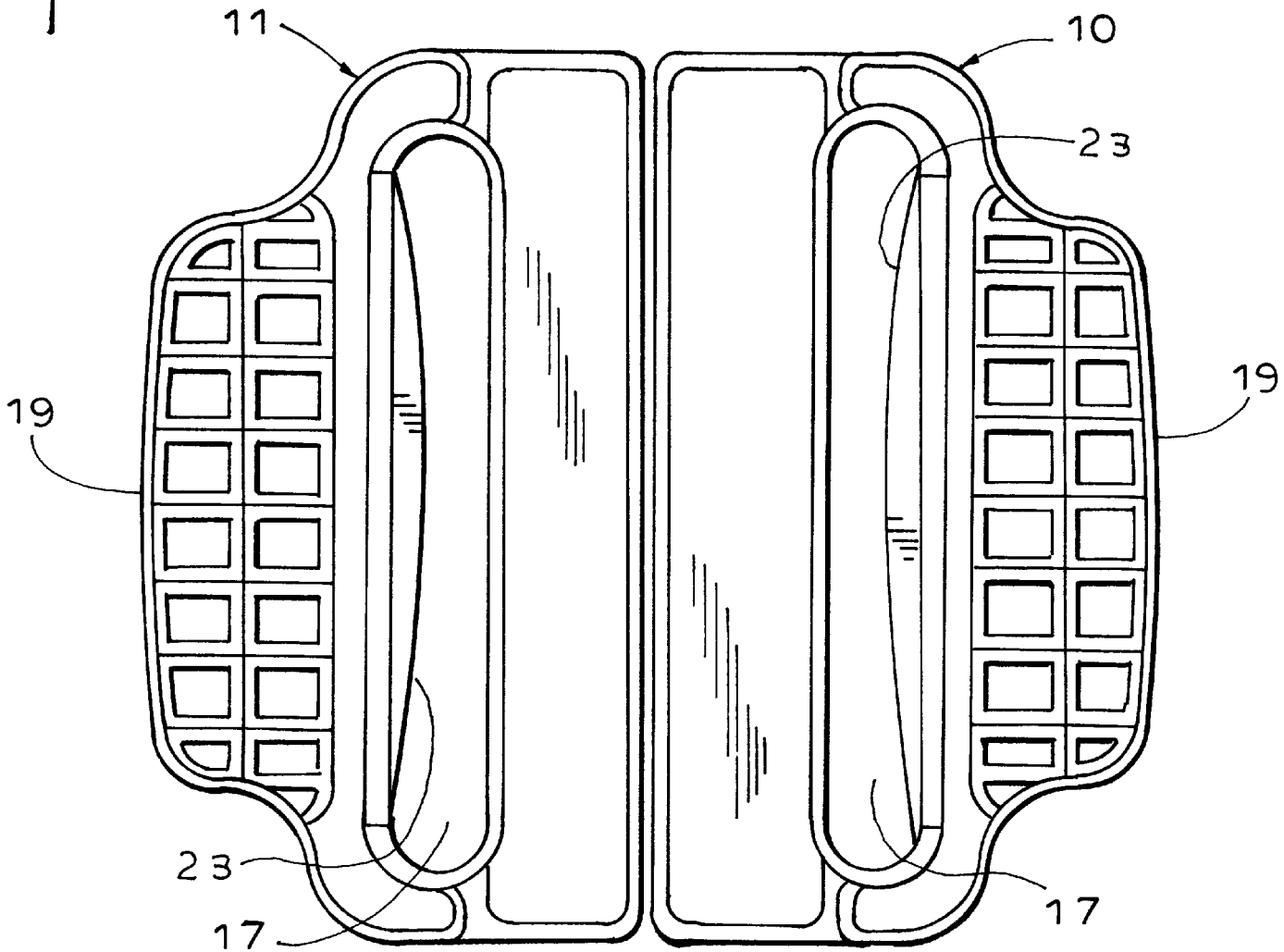
FIG. 1 is a front elevational view of a garment fastener according to the invention.

As can be seen in FIG. 1, a garment fastener according to the invention can comprise two fastener halves 10 and 11, which can be identical but are inverted with respect to one another so that the two fastener halves releasably interfit.

Figure 2:
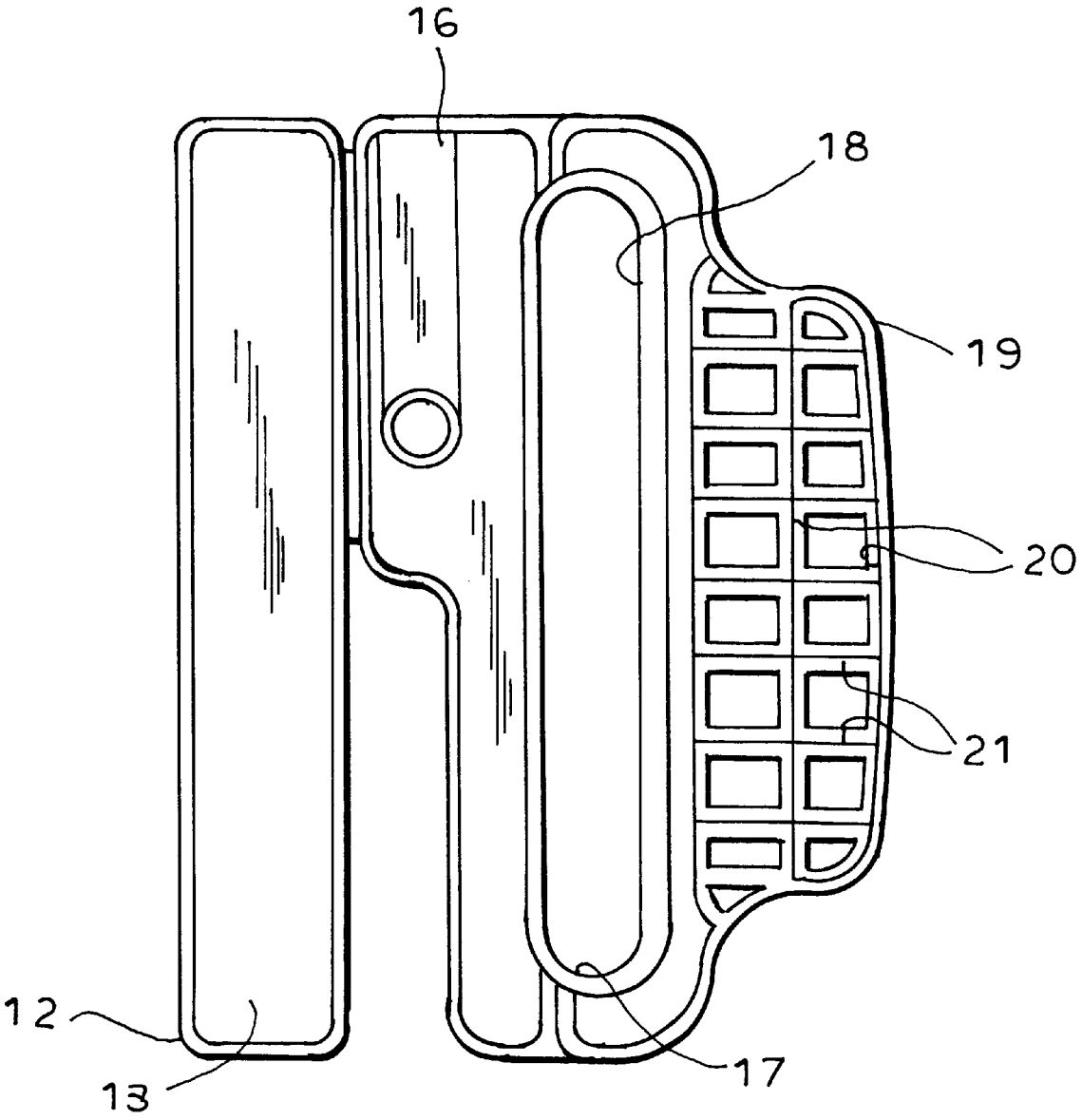
FIG. 2 is a front view of one fastener half, the other fastener half being identical thereto but inverted relative to the first fastener half.
Figure 3:
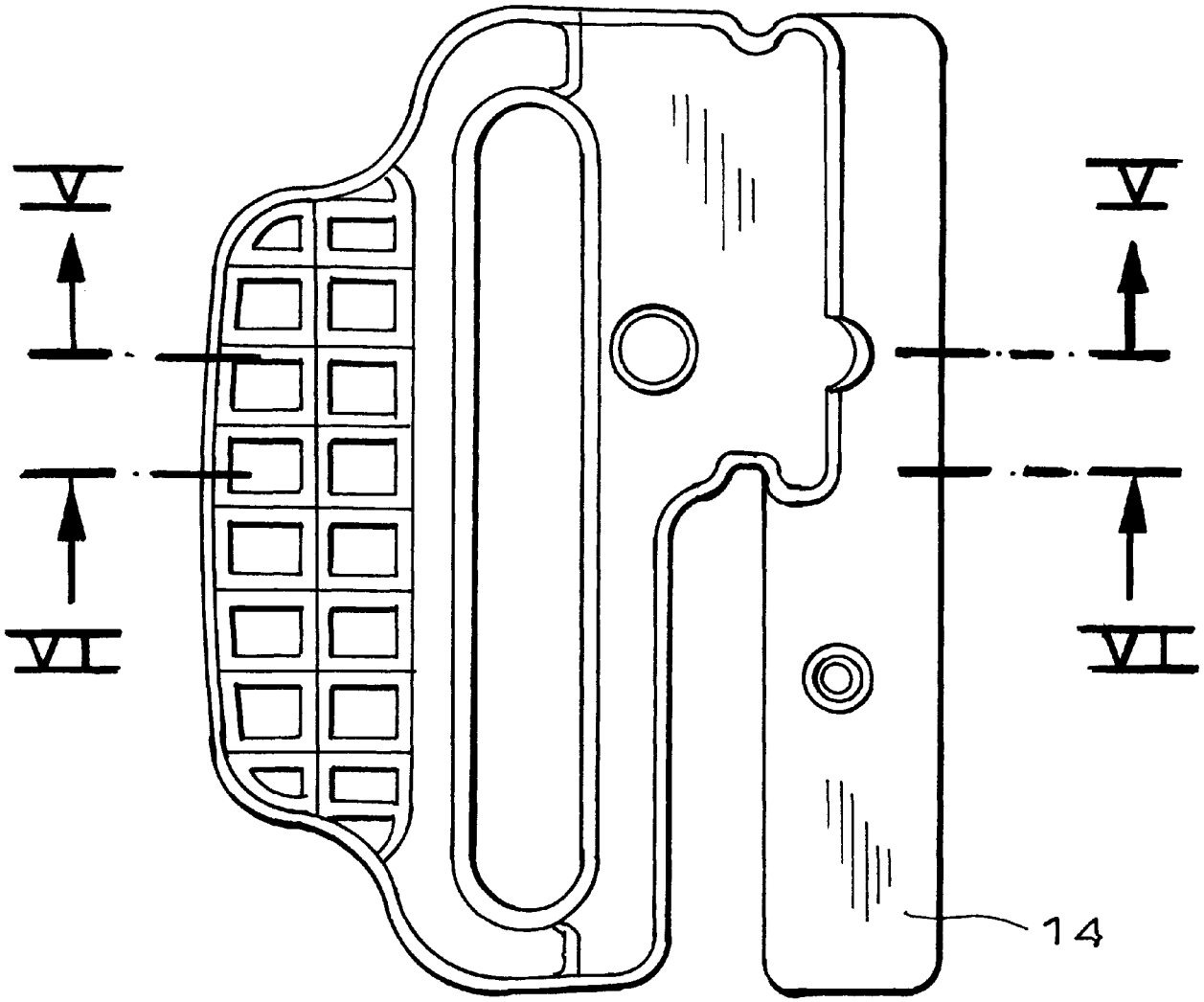
FIG. 3 is a rear view of the fastener half shown in FIG. 2.

As can be seen from FIGS. 2 and 3, which show a fastener half of slightly different construction from that of FIG. 1, each fastener half comprises a body 12 having a rounded surface 13 and on side a flat surface 14 on the opposite side and generally is stepped as shown at 15 over half the length of that body.

Figure 6:
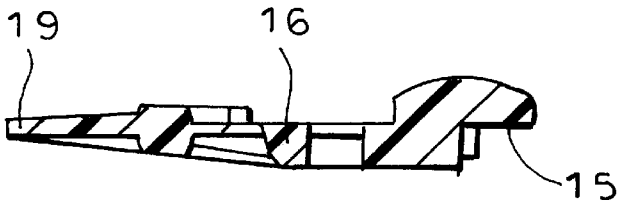
FIG. 6 is a cross sectional view taken along the line VI—VI of FIG. 3.
Figure 4:
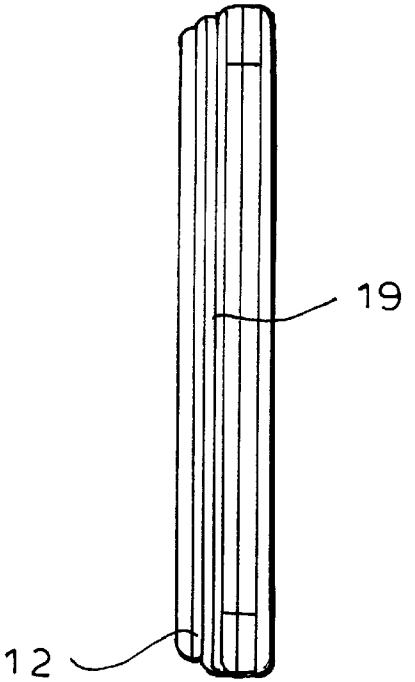
FIG. 4 is an end view thereof from the side of the attachment flange.
Figure 5:
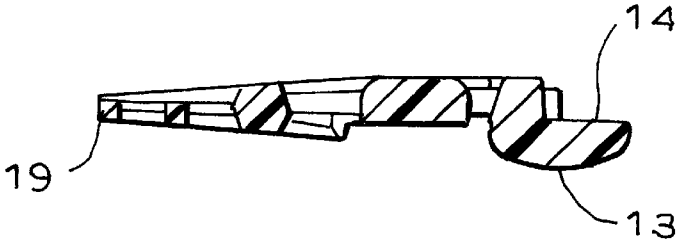
FIG. 5 is a cross sectional view taken along the line V—V in FIG. 3.

The body is unitary with an elongated loop 16 having a slot 17 which is defined by a bar 18 on the side of the slot opposite the body. From that bar, an attachment flange 19 projects. The attachment flange is an openwork structure of ribs 20 parallel to the bar 18 and ribs 21 perpendicular to the bar 18. As can be seen from FIGS. 5 and 6, the attachment flange tapers in thickness away from the body and has a thickness which can be less than half the thickness of the loop 16 and less than a quarter of the thickness of the body 12.

Figure 7:
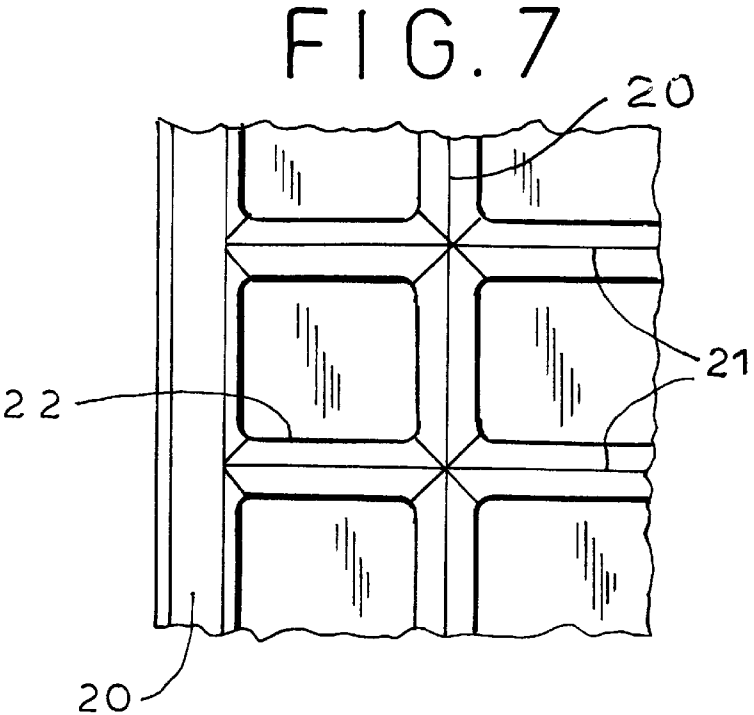
FIG. 7 is a detail view of the rib structure of the attachment flange.

The bar structure has been shown in detail in FIG. 7 and the openings 22 between the bars are visible here as well.

Figure 8:
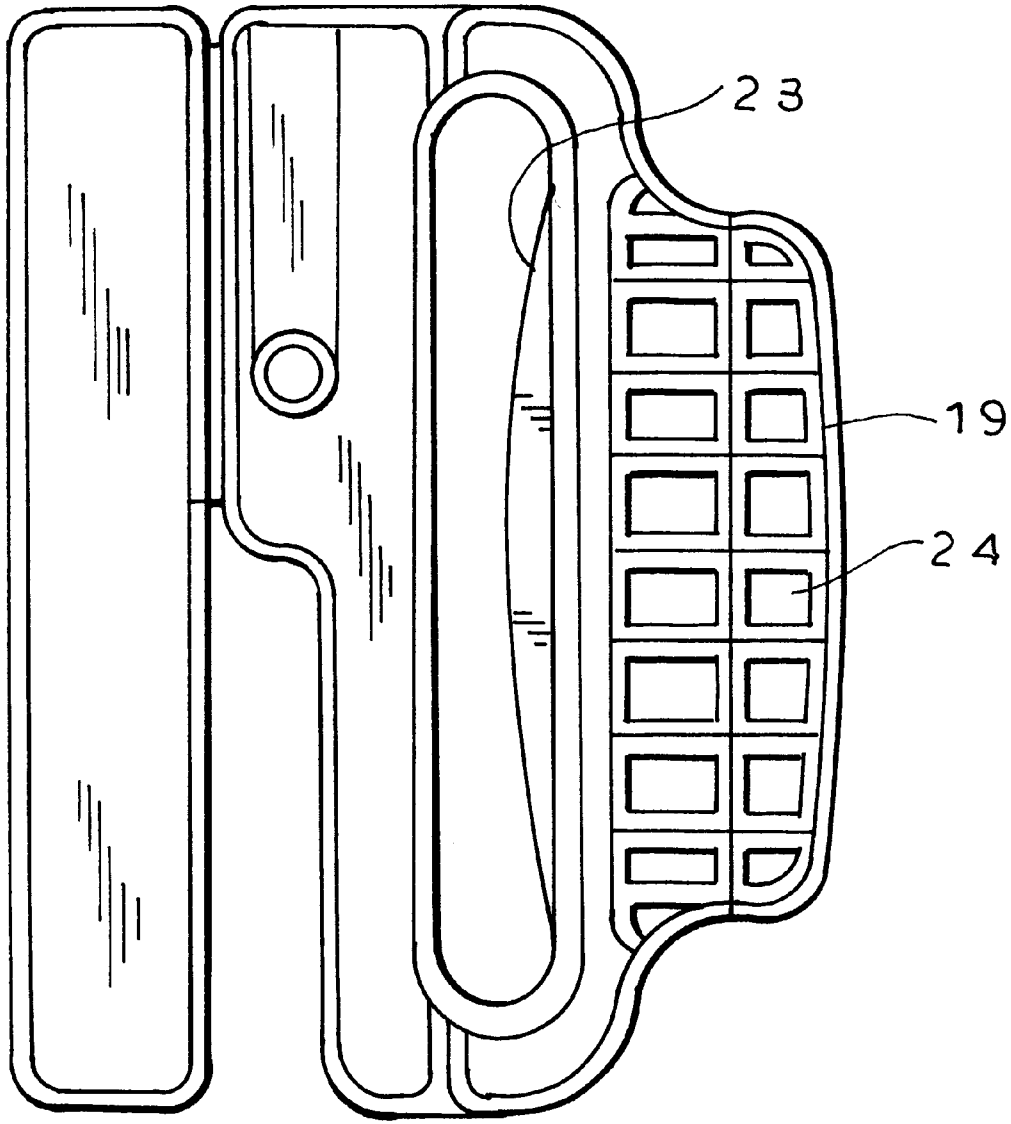
FIG. 8 is a front elevational view of a fastener half for use in the fastener of FIG. 1.

The bar 18 can be formed as shown in FIGS. 1 and 8 with an inwardly extending bulge 23 over the entire length of the slot 17. As can be seen from FIG. 8, the bulge 23 can be of a thickness which is of the order of that of the attachment flange 19. The latter need not be an openwork structure and can have webs which are thinner than the bars 20 and 21 bridging between them as is apparent at 24 in FIG. 8.

Figure 9:
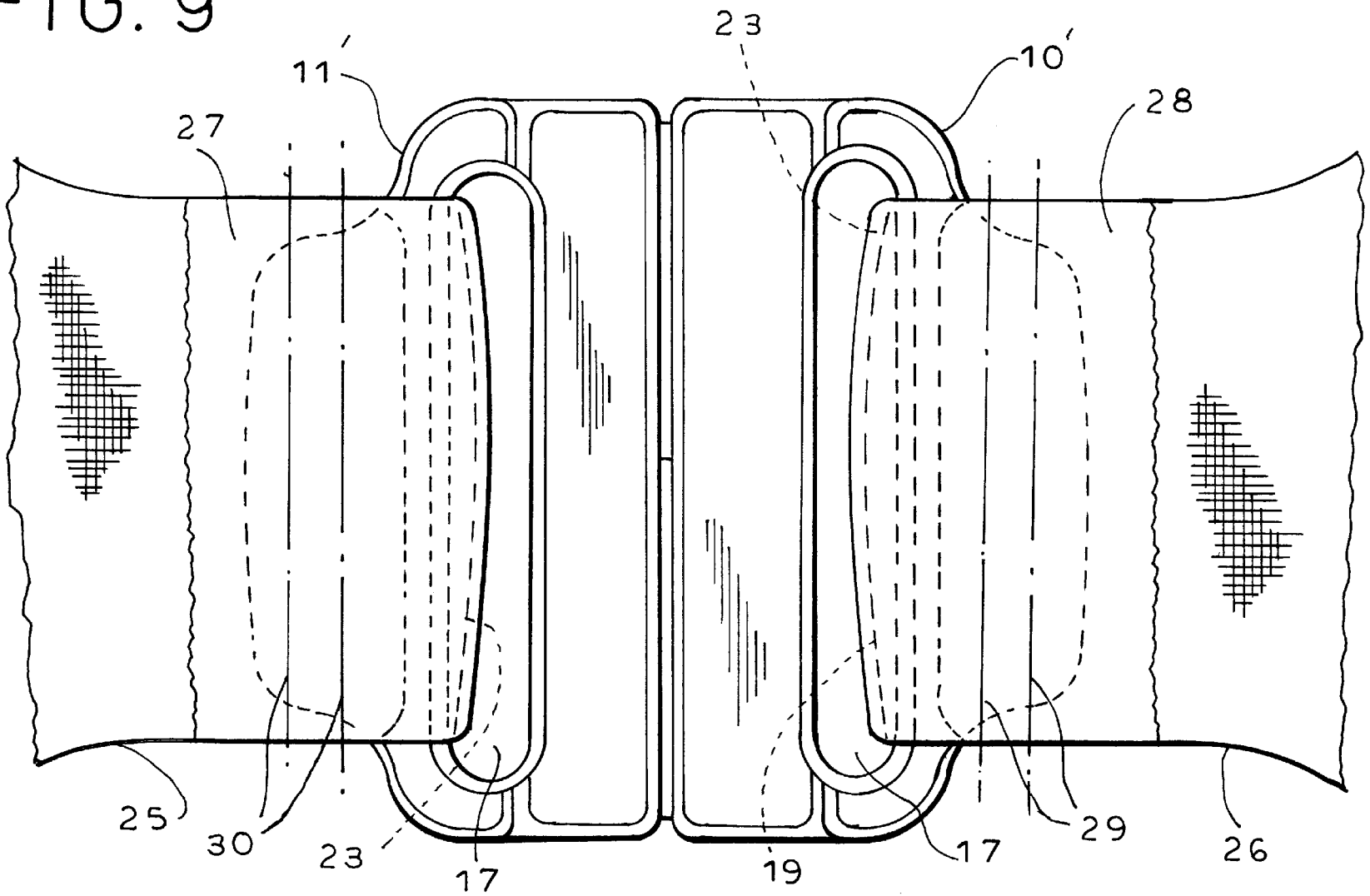
FIG. 9 is a fragmentary elevational view of a garment provided with the fastener of FIG. 1.

FIG. 9 shows two fastener halves 10' and 11' with fabric strips or straps extending through the slots 17 and folded over. The strips are represented at 25 and 26 and the folded-over ribs at 25 and 26 and the folded-over portions are shown at 27 and 28, respectively. At the right-hand side of FIG. 9, the folded-over portion 28 is stitched to the fabric strip 26 with rows of stitching 29 piercing through attachment flange 19 of the fastener half 10'. The rows of stitching may be released by the user, if the garment is to be expanded slightly, and restitched after some of the strip 26 has been pulled out of the slot 17 of the fastener half 10'. The bulges 23 serve to uniformly spread the fabric over the length of the slot and prevent bunching of the fabric at one end of the slot. The fastener half 11' is affixed to the strip 25 and its overlying portion 27 at least in part by weld seams along the dot-dash lines 30.

In use, two identical fastener halves are joined together by inverting one relative to the other and slipping the bodies alongside one another as has been shown in FIGS. 1 and 9.

We claim:

1. A garment comprising:

a first and a second garment parts, and a garment fastener detachably securing said parts together, said garment fastener comprising a first fastener half secured to said first garment part and a second garment fastener identical to said first fastener half and secured to said second garment part, each of said fastener halves comprising:

a fastener body adapted to be affixed to the respective garment part and provided with formations detachably engageable with the body of the other fastener half, a respective loop formed on each body and provided with an elongated slot through which a portion of the respective garment part passes, and a respective attachment flange coplanar with each of said loops and of a thickness smaller than that of the respective body and loop and projecting from the respective loop away from the respective body and overlain by a portion of the respective garment part adjacent the portion passed through the respective loop, said attachment flange being secured to the respective portion overlying same.

2. The garment defined in claim 1 wherein at least one of said attachment flanges is secured to the respective portion in a manner enabling detachment by a wearer of the garment to enable reattachment in a different relative position of the respective portion and attachment flange.

3. The garment defined in claim 2 wherein said one of said attachment flanges is secured to the respective portion by stitching.

4. A garment fastener comprising:

a fastener body adapted to be affixed to first part of a garment;

a loop formed on said body and provided with an elongated slot through which a portion of a second part of said garment can be passed; and an attachment flange coplanar with said loop and of a thickness smaller than that of said body and said loop projecting from said loop away from said body and overlain by a portion of said second part of said garment adjacent the portion passed through said loop, said attachment flange being secured to said second part of the garment by stitching along said portion of said second part overlying the attachment flange, said attachment flange tapering in thickness away from said loop.

5. The garment fastener defined in claim 4 wherein said attachment flange is secured to said portion of said second part overlying the attachment flange at least in part by stitching through said attachment flange.

6. The garment fastener defined in claim 5 wherein said attachment flange is secured to said portion of said second part overlying the attachment flange at least in part by welding.

7. The garment fastener defined in claim 4 wherein said attachment flange is secured to said portion of said second part overlying the attachment flange at least in part by welding.

8. The garment fastener defined in claim 4 wherein said loop has a bar defining one side of said slot and formed with an inwardly projecting bulge with a thickness less than that of said loop and extending substantially the full length of the slot.

9. A garment fastener comprising:

a fastener body adapted to be affixed to first part of a garment;

a loop formed on said body and provided with an elongated slot through which a portion of a second part of said garment can be passed; and an attachment flange coplanar with said loop and of a thickness smaller than that of said body and said loop projecting from said loop away from said body and overlain by a portion of said second part of said garment adjacent the portion passed through said loop, said attachment flange being secured to said second part of the garment along said portion of said second part overlying the attachment flange, said attachment flange tapering thickness away from said loop and being formed on at least one side with an array of mutually orthogonal tapered cross section ribs including ribs parallel to longitudinal sides of said slot and ribs transverse to said longitudinal sides of the slot.

10. The garment fastener defined in claim 9 wherein said attachment flange is formed on opposite sides with respective arrays of mutually orthogonal ribs.

11. A garment fastener comprising:

a fastener body adapted to be affixed to first part of a garment;

a loop formed on said body and provided with an elongated slot through which a portion of a second part of said garment can be passed; and an attachment flange coplanar with said loop and of a thickness smaller than that of said body and said loop projecting from said loop away from said body and overlain by a portion of said second part of said garment adjacent the portion passed through said loop, said attachment flange being secured to said second part of the garment along said portion of said second part overlying the attachment flange, said body, said loop and said attachment flange forming a first fastener half, said garment fastener further comprising a second fastener half with a fastener body mating with the fastener body of said first fastener half, a respective loop formed on said body if said second fastener half and provided with a respective elongated slot through which a portion of said first part of said garment can be passed, and a respective attachment flange coplanar with said loop of said second fastener half and of a thickness smaller than that of said body and said loop of said second fastener half projecting from said loop of said second fastener half away from said body of said second fastener half and overlain by a portion of said first part of said garment adjacent the portion passed through said loop of said second fastener half, said attachment flange of said second fastener half being secured to said first part of the garment along said portion of said first part overlying the attachment flange of said second fastener half.

12. The garment fastener defined in claim 11 wherein said first and second fastener halves are identical to one another.

13. The garment fastener defined in claim 12 wherein said attachment flanges taper in thickness away from the respective loops.

14. The garment fastener defined in claim 13 wherein at least one of said attachment flanges is secured to the respective portion overlying the respective attachment flange at least in part by stitching through the respective attachment flange.

15. The garment fastener defined in claim 14 wherein the stitched through attachment flange is further secured to the overlying portion by welding.

16. The garment fastener defined in claim 13 wherein at least one of said attachment flanges is secured to the portion overlying same by welding.

17. The garment fastener defined in claim 13 wherein each of said attachment flanges is formed on at least one side with an array of mutually orthogonal ribs.

18. The garment fastener defined in claim 17 wherein each of said attachment flanges is formed on opposite sides with respective arrays of mutually orthogonal ribs.

19. The garment fastener defined in claim 18 wherein each of said loops has a bar defining one side of the respective slot and formed with an inwardly projecting bulge with a thickness less than that of the respective loop and extending substantially the full length of the respective slot.

* * * * *